US006244003B1

(12) United States Patent
Allison

(10) Patent No.: US 6,244,003 B1
(45) Date of Patent: Jun. 12, 2001

(54) BUILDING ROOM STRUCTURE

(75) Inventor: Eric S. Allison, Dublin, OH (US)

(73) Assignee: Dominion Homes, Inc., Dublin, OH (US)

( * ) Notice: Subject to any disclaimer, the term of this patent is extended or adjusted under 35 U.S.C. 154(b) by 0 days.

(21) Appl. No.: 09/137,586

(22) Filed: Aug. 21, 1998

(51) Int. Cl.[7] ..... E04H 1/00

(52) U.S. Cl. ..... 52/234; 52/236.3; 52/236.4; 52/169.1; 52/169.6; 434/72

(58) Field of Search ..... 52/236.3, 236.4, 52/169.1, 234, 169.6; 434/72

(56) References Cited

U.S. PATENT DOCUMENTS

| | | | | |
|---|---|---|---|---|
| 2,168,725 | * | 8/1939 | Whelan | 52/236.3 |
| 2,559,261 | * | 7/1951 | Schwartz | 434/72 |
| 3,884,001 | * | 5/1975 | Tylius | 52/236.4 |
| 5,975,908 | * | 11/1999 | Hulten | 434/72 |

OTHER PUBLICATIONS

Distinguished Homes and Plans, Issue No. DHP 24, p. 37, Mar. 1993.*

House Beautiful Houses and Plans, 1995 Edition, pp. 199–200, Mar. 1995.*

* cited by examiner

*Primary Examiner*—Carl D. Friedman
*Assistant Examiner*—Dennis L. Dorsey
(74) *Attorney, Agent, or Firm*—Standley & Gilcrest LLP

(57) ABSTRACT

The present invention includes a unique mid-level room arrangement for a building structure such as a residential home. The building structure is comprised of at least one room on a first below ground level floor and at least one room on a second below ground level floor. The second below ground level floor is above the first below ground level floor, and a stairway connects the first below ground level floor to the second below ground level floor. The building is also comprised of at least one room on a generally ground level floor. The second below ground level floor is connected to the ground level floor by a stairway. There is also at least one room on an upper level floor above the ground level floor. A stairway connects the ground level floor with the upper level floor, and it has a landing at a location between the ground level floor and the upper level floor. At least one room is on a mid-level floor between the ground level floor and the upper level floor. The room on the mid-level floor is accessible from the landing. The mid-level room provides improved living in any building structure that incorporates the unique arrangement. The present invention is useful in practically any overall design that can accommodate the arrangement. An optional lower level room may be provided.

17 Claims, 16 Drawing Sheets

OPTIONAL FINISHED LOWER LEVEL/ 5TH BEDROOM

| WINDOW INFORMATION | | | | | | | | |
|---|---|---|---|---|---|---|---|---|
| NARROLINE WOOD-CORE DOUBLE HUNG WINDOWS | | | | | | | | |
| ROOM | ROOM SQ. FT. | WINDOW TYPE | REQUIRED GLAZING SQ. FT. | ACTUAL GLAZING SQ. FT. | REQUIRED VENTING SQ. FT. | ACTUAL VENTING SQ. FT. | TEMPERED GLAZING | BEDROOM EGRESS SQ.FT. |
| OPTIONAL FAMILY ROOM | 205 | CW235 | 16.4 | 12 | 8.2 | 11.9 | NO | N/A |
| OPTIONAL 5TH BEDROOM | 113 | CW235 | 9.04 | 12 | 4.52 | 11.9 | NO | 5.7 |
| DEN | 146 | (2) 1052 | 11.68 | 5.6 | 5.84 | N/A | NO | N/A |
| | | 3062 | | 15.3 | | 8.34 | NO | N/A |
| KITCHEN | 145 | 34210 | 11.6 | 7.07 | 5.80 | 3.95 | NO | N/A |
| DINING ROOM | 144 | 90SGD | 11.52 | 44.79 | 5.76 | 22.39 | YES | N/A |
| MASTER BEDROOM | 220 | (2) 2852 | 17.6 | 22 | 8.8 | 12.2 | NO | 12.18 |
| BEDROOM #2 | 126 | 2852 | 10.08 | 11 | 5.04 | 6.10 | NO | 6.09 |
| BEDROOM #3 | 113 | 2852 | 9.04 | 11 | 4.52 | 6.10 | NO | 6.09 |
| BEDROOM #3 | 130 | 2852 | 10.40 | 11 | 5.2 | 6.10 | NO | 6.09 |

FIG-13

ROOF VENTILATION

GENERAL NOTES

1. ALL RIDGE VENTS ARE BY CERTAINTEED
   P.O. BOX 860
   VALLEY FORGE, PA 19482
   1-800-233-8990

SHINGLEVENTS II RIDGE VENTS PROVIDE 18 SQ. INCHES OF NET FREE AREA PER LINEAL FOOT.

2. CONTINUOUS VENTED SOFFIT VENTS PROVIDES 11% OF NET FREE AREA PER LINEAL FOOT.

3. 16"X4" SOFFIT VENTS PROVIDE 23 SQ. INCHES OF NET FREE AREA PER LINEAL FOOT.

FIRST FLOOR

659 SQ. FT. OF ATTIC=94896 SQ. IN./300=316 SQ. IN.
316 SQ. IN. OF VENTING REQUIRED
-216 SQ. IN. OF 12' RIDGE VENTS
100 SQ. IN. REQUIRED IN LOWER 1/3 OF ROOF

MINIMUM OF 10' OF CONT. VENTED SOFFIT IS REQ'D
MINIMUM OF 5-16"X4" SOFFIT VENTS IS REQUIRED

SECOND FLOOR

1343 SQ. FT. OF ATTIC=193392 SQ. IN./300=645 SQ. IN.
645 SQ. IN. OF VENTING REQUIRED
-360 SQ. IN. OF 20' OF RIDGE VENTS
285 SQ. IN. REQUIRED IN LOWER 1/3 OF ROOF

MINIMUM OF 27' OF CONT. VENTED SOFFIT IS REQ'D
MINIMUM OF 13-16"X4" SOFFIT VENTS IS REQUIRED

FIG-14

FOUNDATION NOTES

1. ALL FOOTINGS ARE 16"x8" UNLESS OTHERWISE NOTED.
2. ALL NON-BASEMENT FOOTINGS ARE +5'-4" (12 CRS.) ABOVE BASEMENT FOOTINGS (TOP TO TOP). LOWER LEVEL SLAB FOOTING AT +4'-0"

NOTE:
   NON-BASEMENT FOOTING ELEVATIONS FOR DUBLIN, DELAWARE COUNTY, AND UPPER ARLINGTON ARE TO BE 4'-8" ABOVE BASEMENT FOOTINGS.
   LOWER LEVEL SLAB FOOTING AT +4'-0"
3. MASONRY FIREPLACE FOOTINGS SHALL BE THICKENED TO 12" WITH 6" PROJECTION ON ALL SIDES.
4. TO TIE CONCRETE BLOCK FOUNDATIONS OF DIFFERENT LEVELS, HOLD HIGH FOOTINGS BACK FROM LOWER ELEVATIONS. USE 4x8 LINTELS TO BRIDGE + TIE.
5. COURSING OR ELEVATIONS BEGIN AT *F=0'-0" (TOP OF BASEMENT FOOTING)
   LEGEND:
   F=FOOTING ELEVATION
   CRS # = COURSE NUMBER
6. ALL CROSS HATCHED CONCRETE BLOCK TOPS OUT AT CRS #12 INCLUSIVE. ALL OTHER CONCRETE BLOCK WALLS TOP OUT AT COURSE SHOWN.
7. ALL FOOTING DESIGNS BASED ON 2000 PSF SOIL BEARING.
8. SOLID MASONRY UNIT TO BE INSTALLED UNDER ALL LINTELS.
9. ALL BEAM POCKETS TO BE GROUTED SOLID.
10. ANY FREE STANDING PIER IN EXCESS OF 4 TIMES ITS LEAST DIMENSION SHALL BE GROUTED SOLID.
11. MINIMUM 3" BEARING IS REQUIRED FOR WOOD OR STEEL BEAM ON MASONRY.
12. FOUNDATION WALL REINFORCING AND ANCHORAGE SHALL COMPLY W/ FDN-1 SHEET.
13. ALL CONCRETE BLOCK CORBELS USED AS SLAB SUPPORT TO BE 12X16X8" SOLIDS.

FIG-15A

GENERAL NOTES

1. FOUNDATION, FLOOR PLANS, SECTIONS AND DETAILS ARE BASED ON BASIC EXTERIOR ELEVATIONS. FOR VARIATIONS DUE TO ALTERNATE ELEVATIONS, REFER TO RESPECTIVE ALTERNATE ELEVATION SHEETS.

2. EXTERIOR DIMENSIONS ARE FROM OUT TO OUT OF SHEATHING.

3. INTERIOR DIMENSIONS ARE FROM FACE TO FACE OF FRAMING.

4. ALL INTERIOR PARTITIONS ARE 2x4 (3 1/2") UNLESS OTHERWISE NOTED.

5. ALL CROSS HATCHED AREAS ON FLOOR PLANS INDICATE SOFFITS, DROPPED CEILING AND PLANT SHELVES.

6. LIVE LOADS: FOOTINGS 2000PSF
   FIRST FLOOR 40PSF
   SECOND FLOOR 40PSF
   ROOF 25PSF

7. LUMBER GRADES:
   UNLESS OTHERWISE SPECIFIED ALL WOOD FRAMING SHALL HAVE THESE MINIMUM VALUES:
   E = 1,300,000
   Fb = 1000 REPETITIVE
   Fb = 875 SINGULAR

7A STRUCTURAL MEMBERS OF 2X8 OR GREATER WILL HAVE THESE MINIMUM VALUES:
   E = 1,600,000
   Fb = 1400 REPETITIVE
   Fb = 1200 SINGULAR

8. FLOOR AND ROOF TRUSSES TO BE DESIGNED BY TRUSS MANUFACTURER.

FIG-15B

BUILDING ROOM STRUCTURE

BACKGROUND AND SUMMARY OF THE INVENTION

The present invention relates generally to building structures and more particularly to a unique room arrangement for a structure such as a residential home. Many families have concerns that their children sleep in rooms far away from the parents yet the parents desire some degree of privacy within the family unit. Home designers have tried to arrive at different designs that serves the purpose of privacy yet family closeness for safety reasons in case of fire, burglary, etc. While these concerns exist there are competing concerns for architectural beauty, economy, and efficiency or "livability." The present invention enables a structure that allows close room association yet a comfortable degree of privacy, while maintaining economical considerations of the cost of the structure and architectural beauty.

The present invention comprises a structure including at least one room on a substantially ground level floor, at least one room on an upper floor above the ground level floor, a stairway connecting the ground level floor with the upper level floor, the stairway having a landing at a location between the ground level floor and the upper level floor, and at least one room on a mid-level floor accessible from the landing. The structure may further include at least one room on a below ground level floor and directly below the mid-level floor.

BRIEF DESCRIPTION OF THE DRAWINGS

FIG. 13 is the window information for the structure of FIG. 1;

FIG. 14 is the roof ventilation information for the structure of FIG. 1;

FIG. 15A is the foundation information for the structure of FIG. 1; and

FIG. 15B is general construction information for the structure of FIG. 1.

DETAILED DESCRIPTION OF PREFERRED EMBODIMENT(S)

Figure 1:
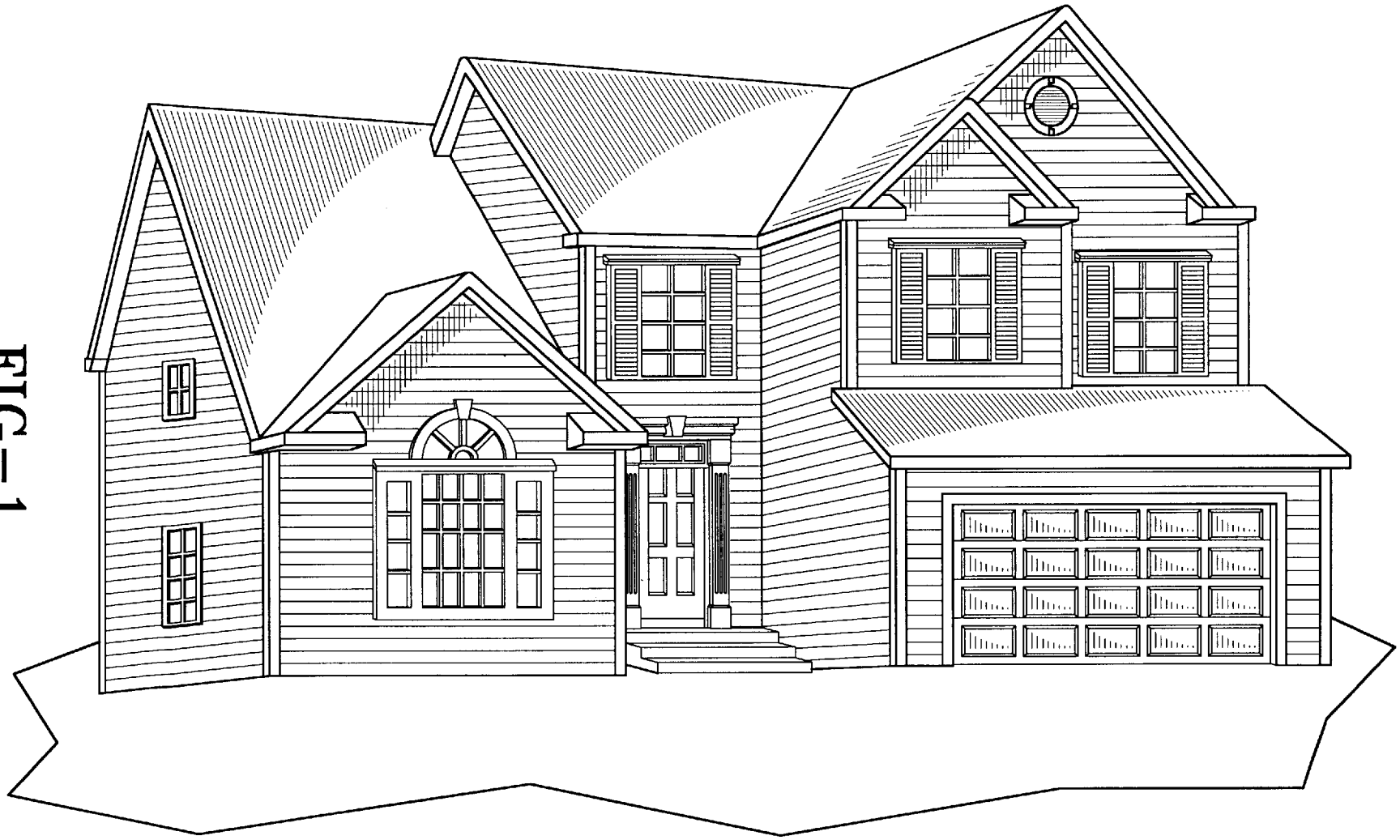
FIGS. 1 shows a perspective view of a preferred structure which incorporates the present invention.

In accordance with the present invention a preferred embodiment of a residential home which incorporates the unique room structure is shown in the drawings. One skilled in the art of home construction will recognize the drawings as architectural/construction drawings. While the figures show one particular structure for purposes of describing the invention, it is to be recognized that many different styles and designs of overall structures may make use of the unique room arrangement structure of the present invention. In other words, many buildings that may have very different facades and different overall floor plans may nevertheless incorporate the present invention and the home shown in the figures is merely an example of one such overall structure that utilizes the present invention.

Figure 2A:
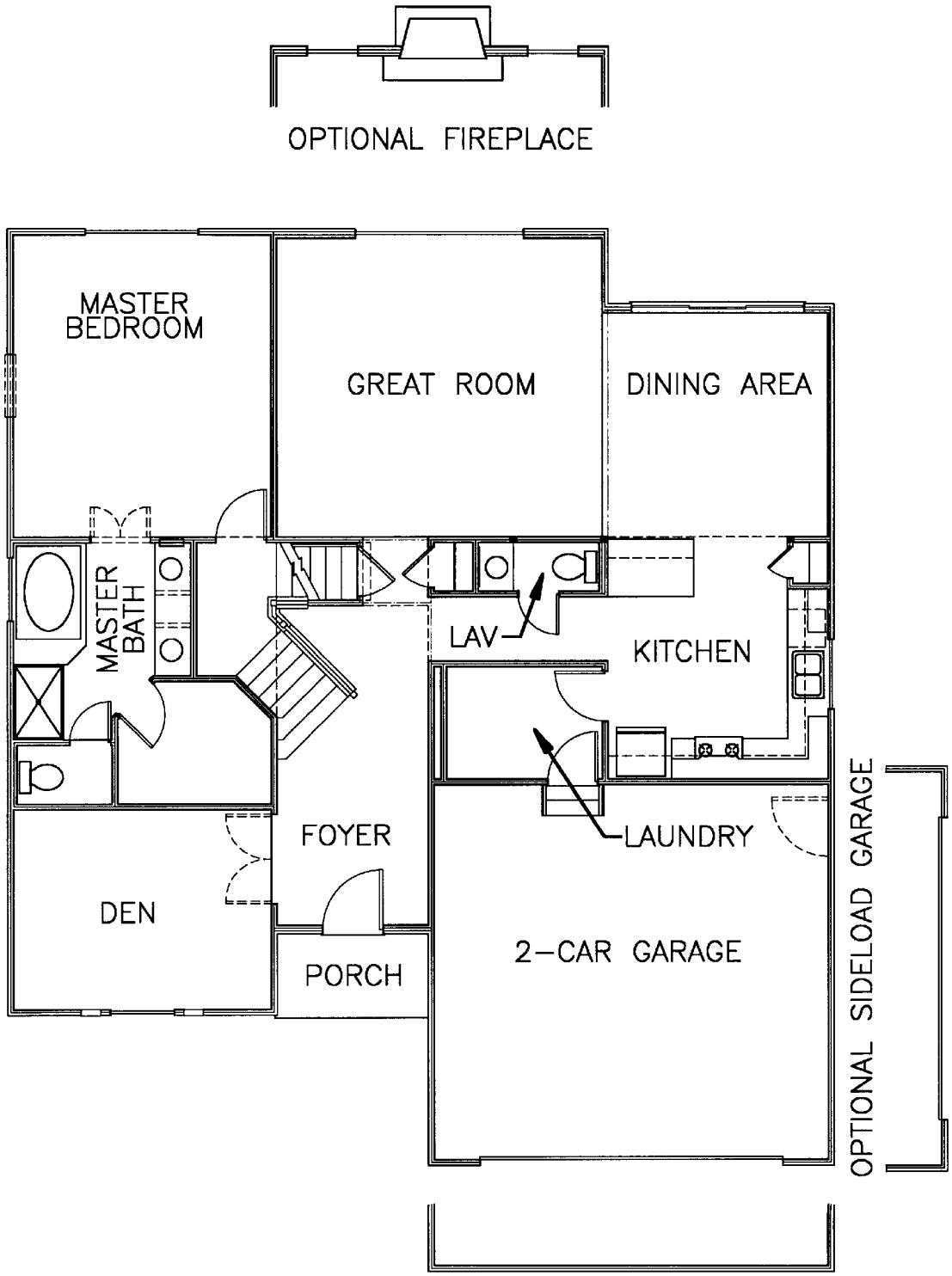
FIGS. 2A–2C are schematic representations of the floor plans is a schematic representation of a floor plan of the structure of FIG. 1.
Figure 2B:
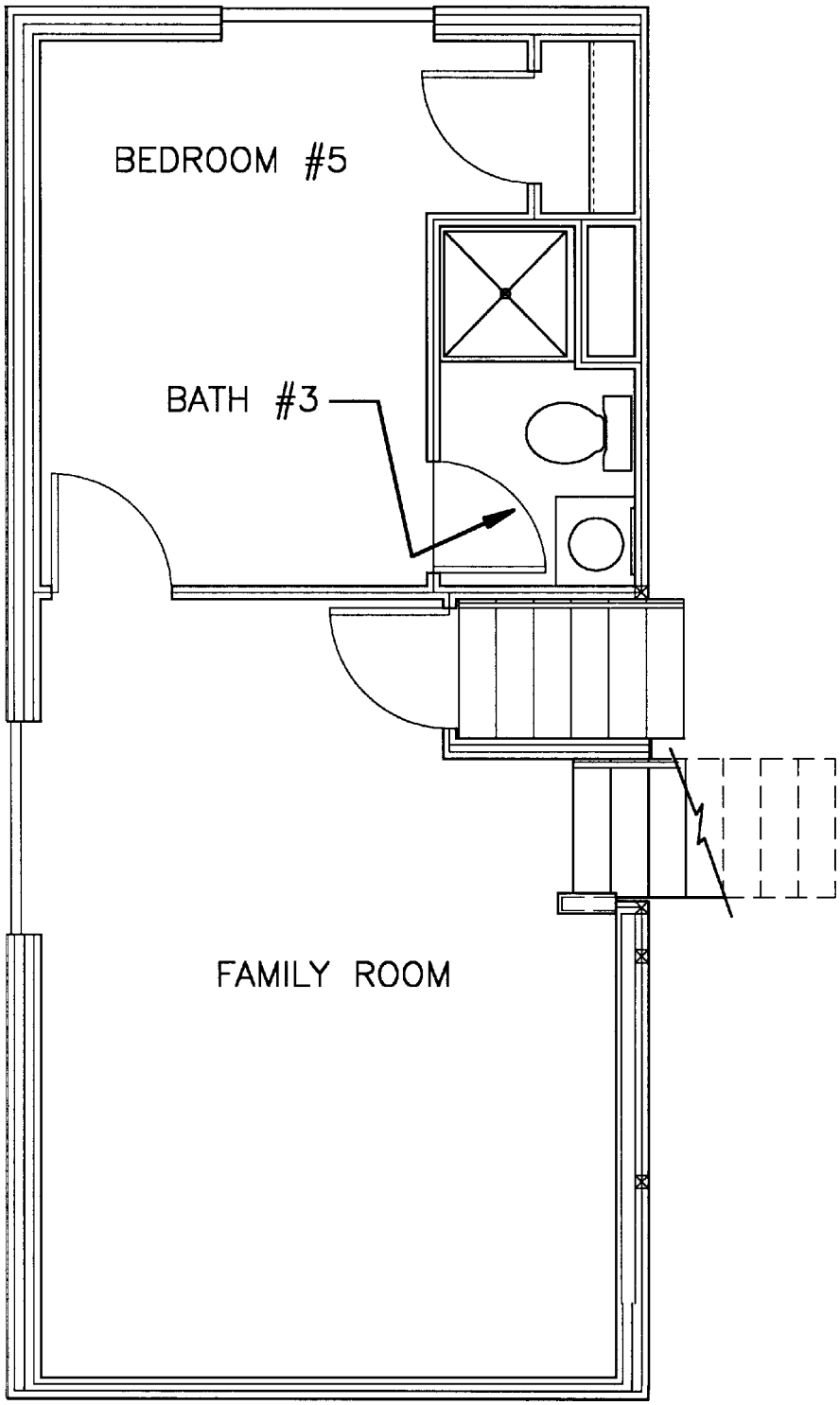
Figure 2C:
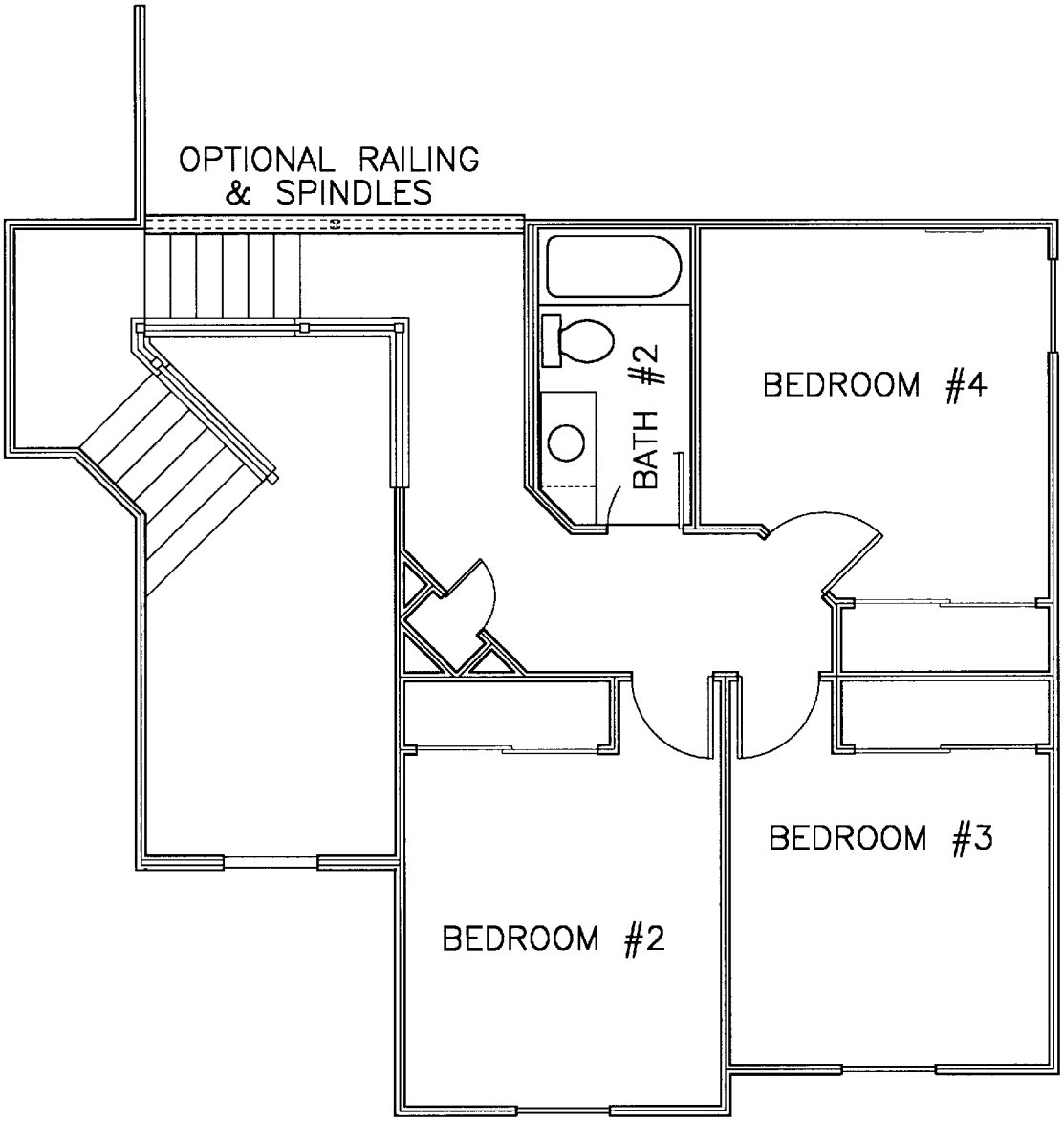
Figure 3:
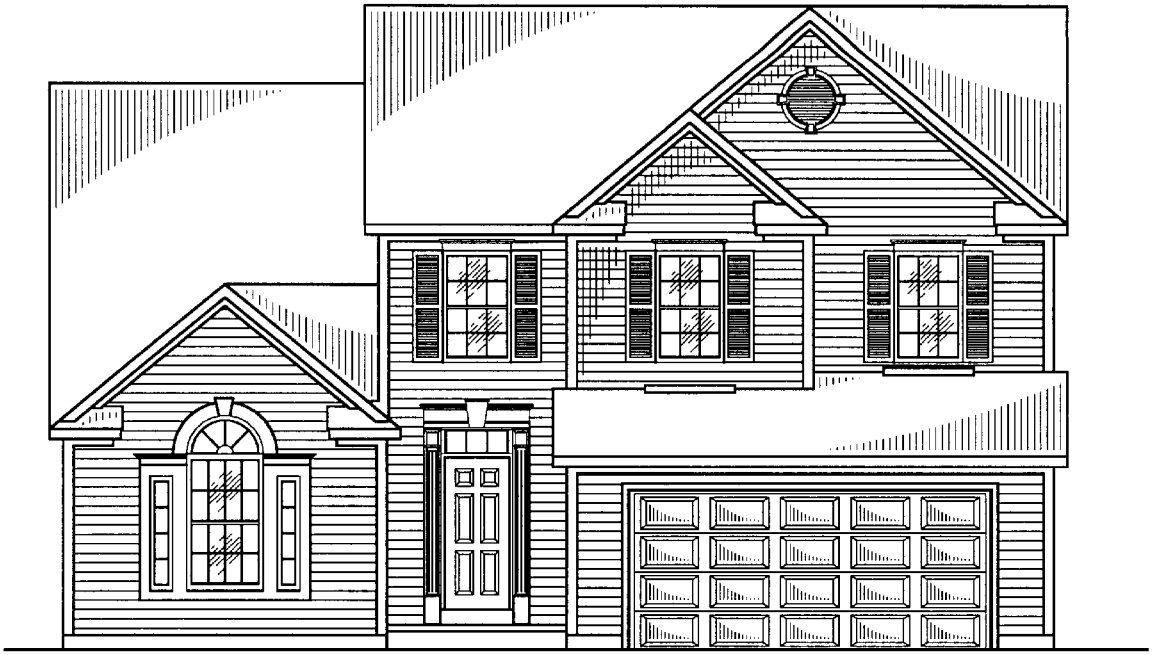
FIG. 3 is a front plan view of the structure of FIG. 1.
Figure 4:
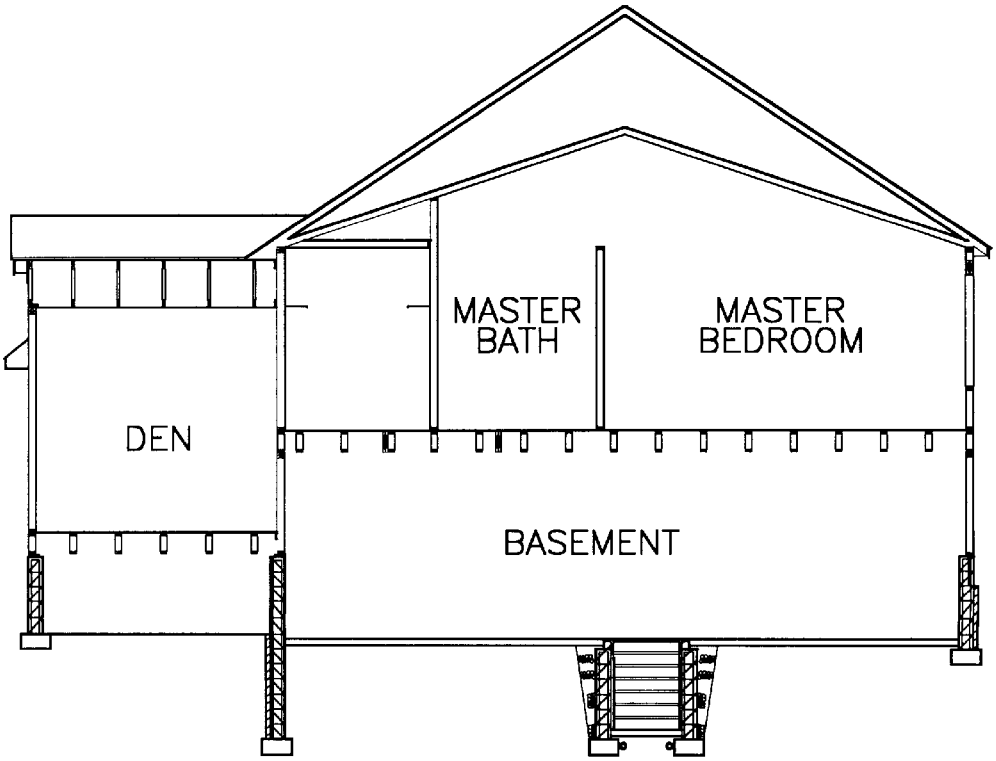
FIG. 4 is a cross section view of the structure of FIG. 1.
Figure 5:
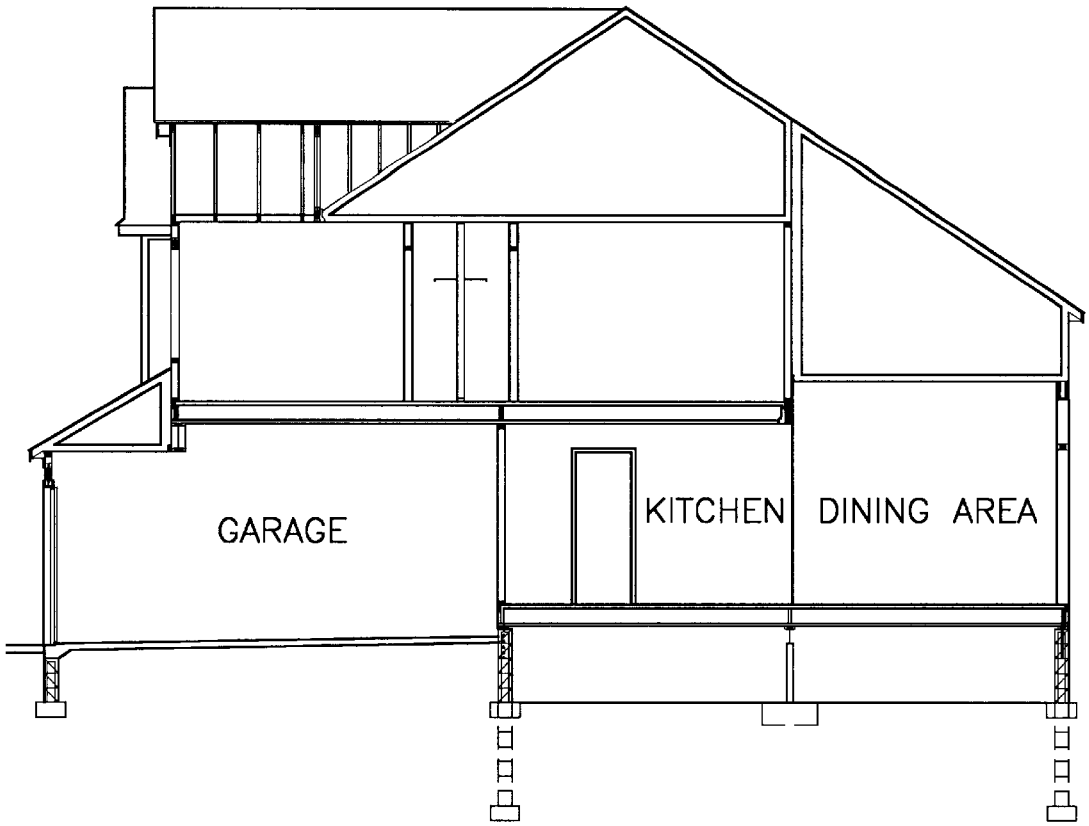
FIG. 5 is a second cross section view of the structure of FIG. 1.
Figure 6:
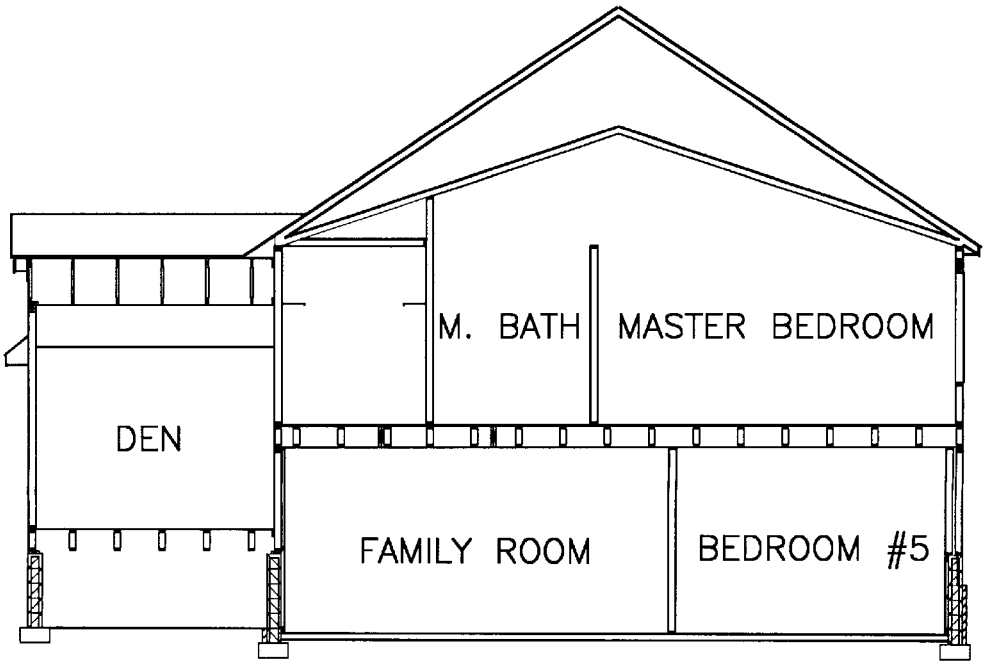
FIG. 6 is a third cross section view of the structure of FIG. 1.
Figure 7:
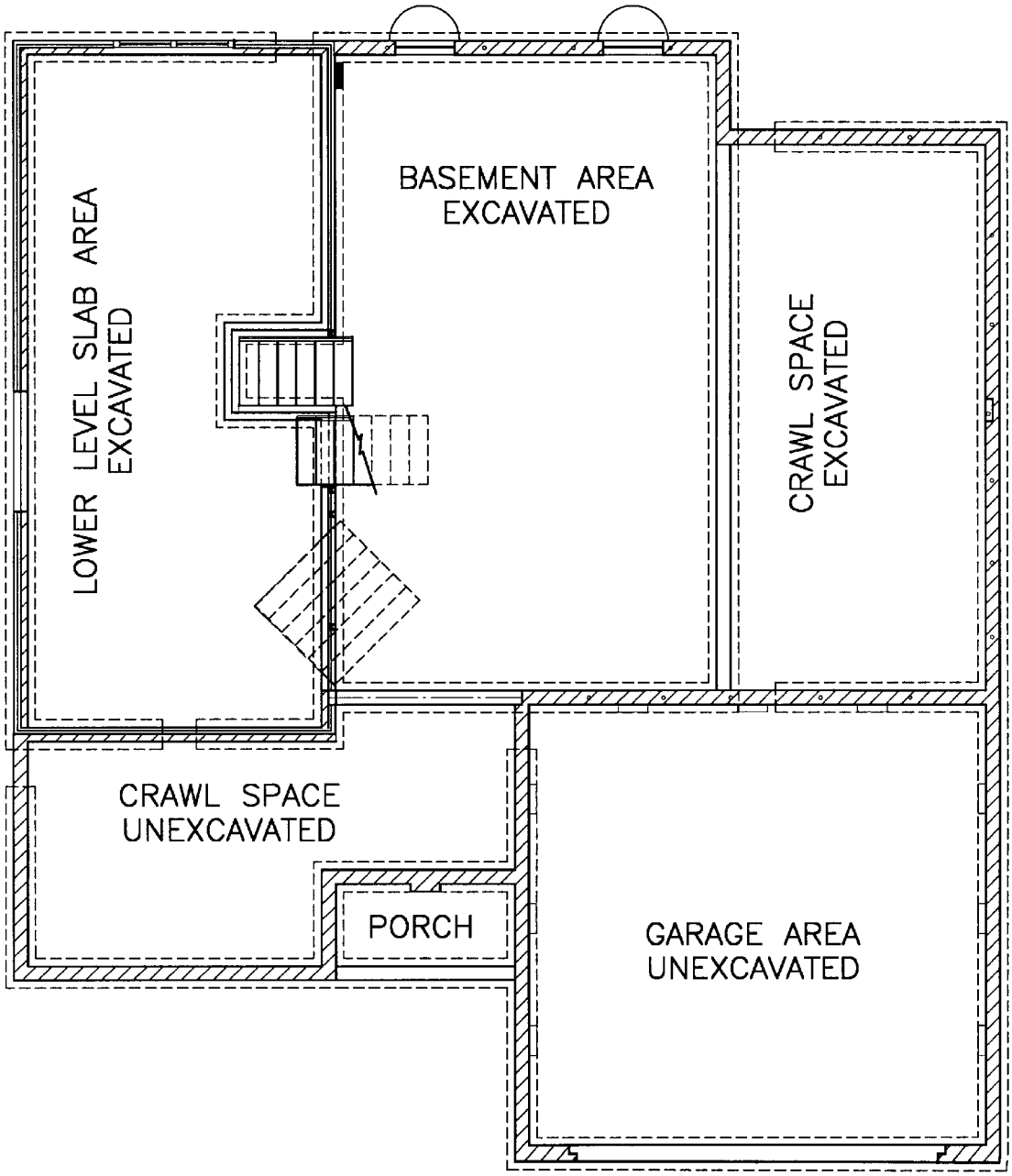
FIG. 7 is a foundation plan view of the structure of FIG. 1.
Figure 8:
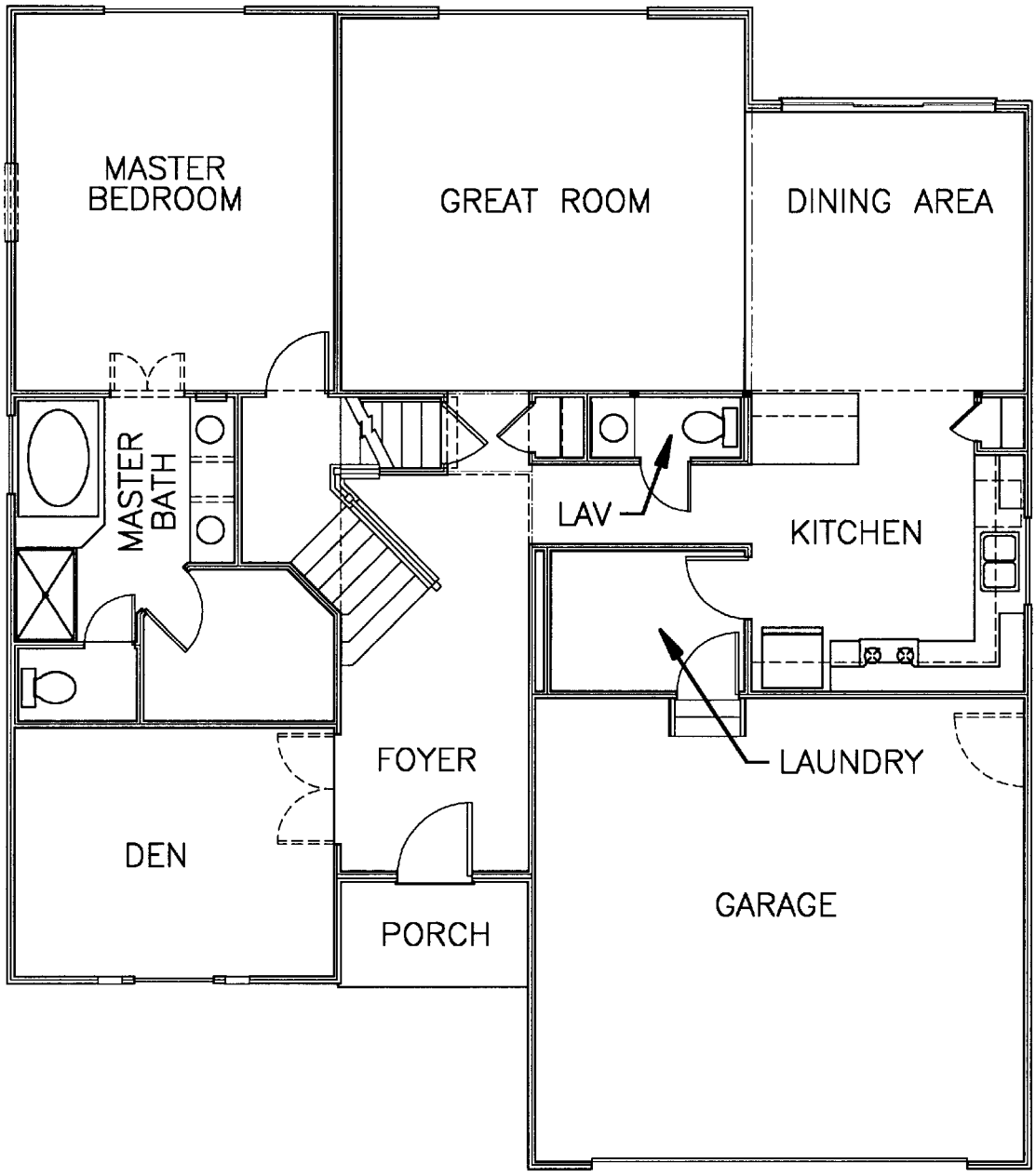
FIGS. 8–10 are another set of schematic representations of the floor plans of the structure of FIG. 1.
Figure 9:
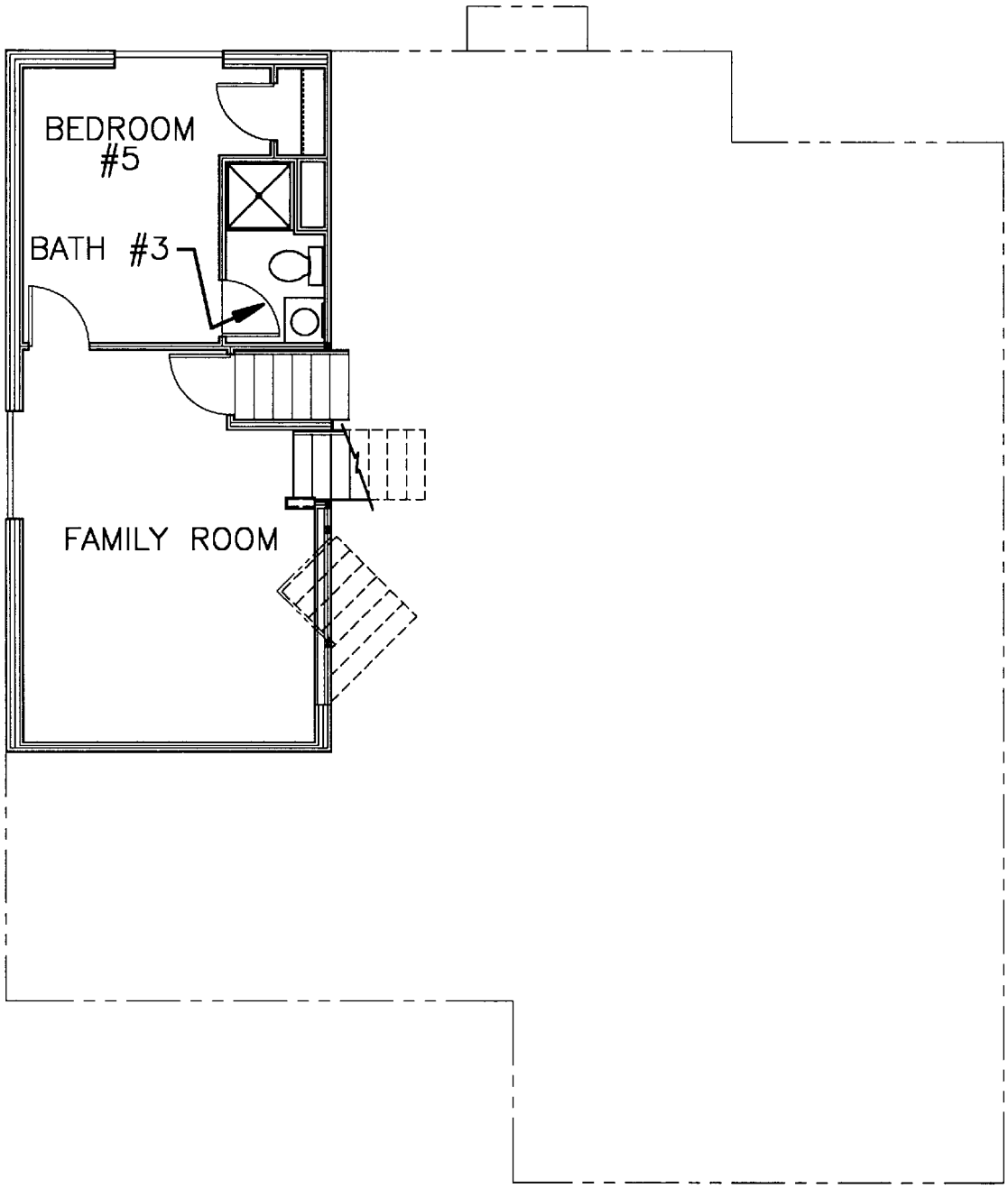
Figure 10:
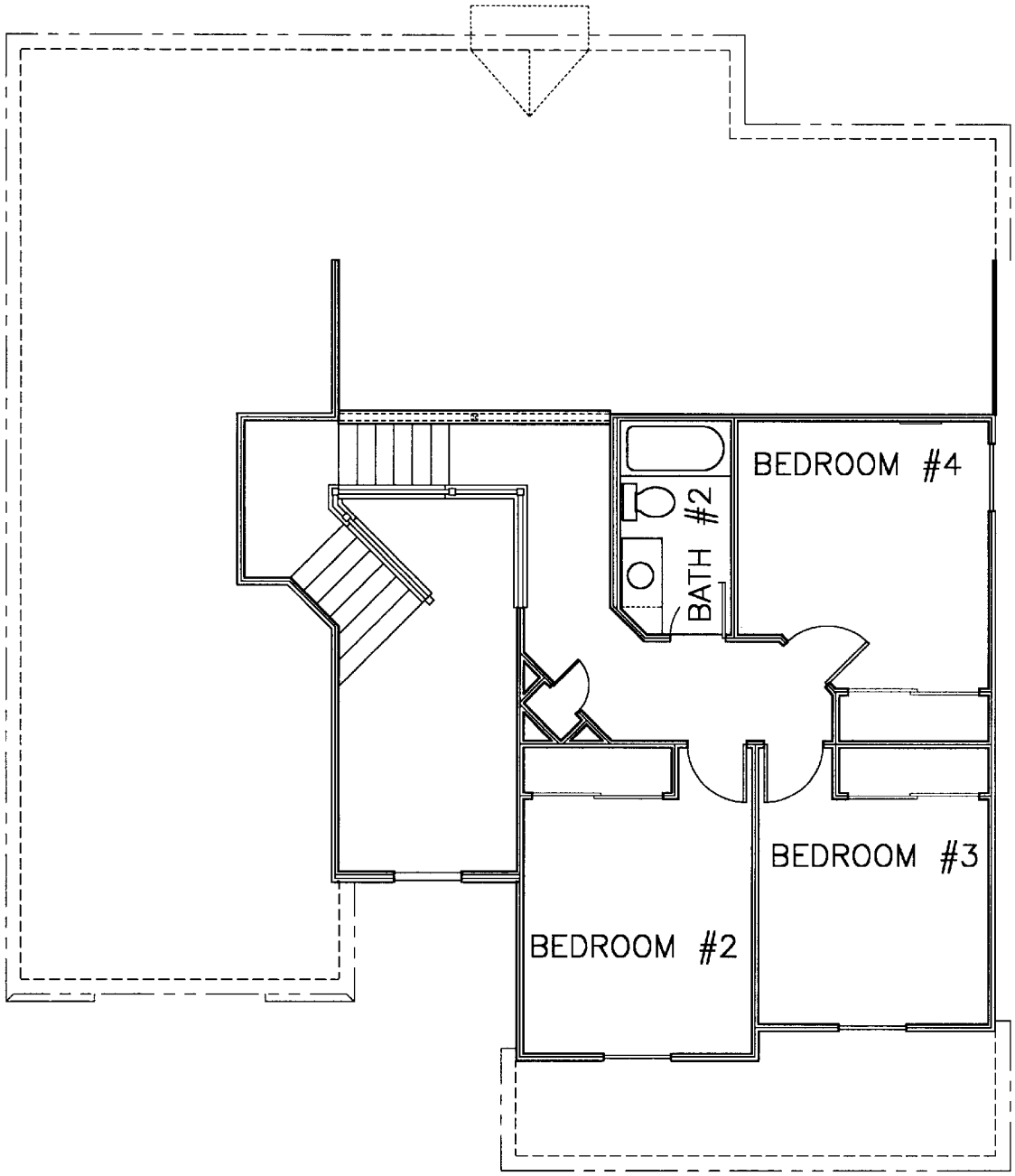
Figure 11:
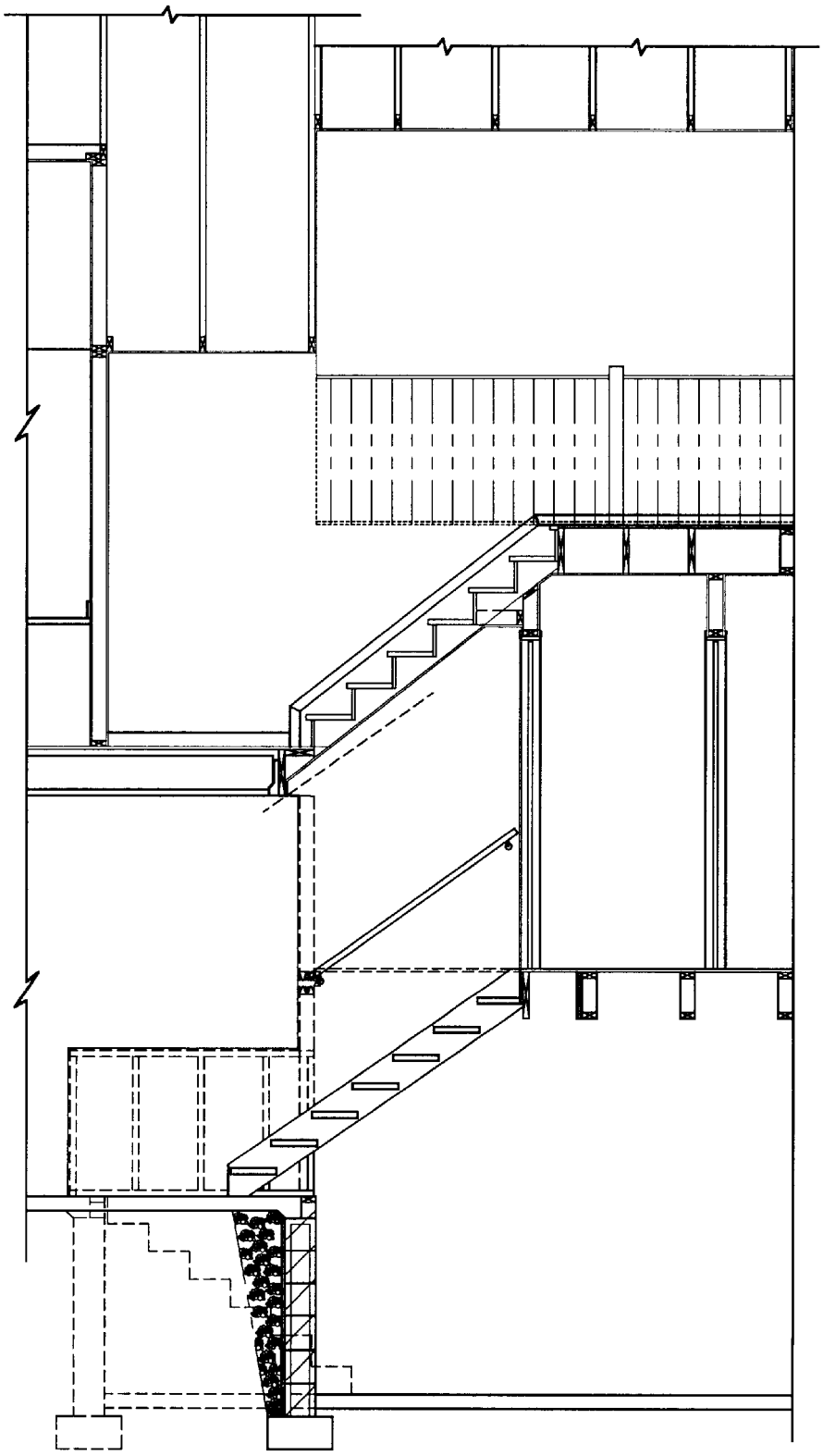
FIG. 11 is a fourth cross section view of the structure of FIG. 1.
Figure 12:
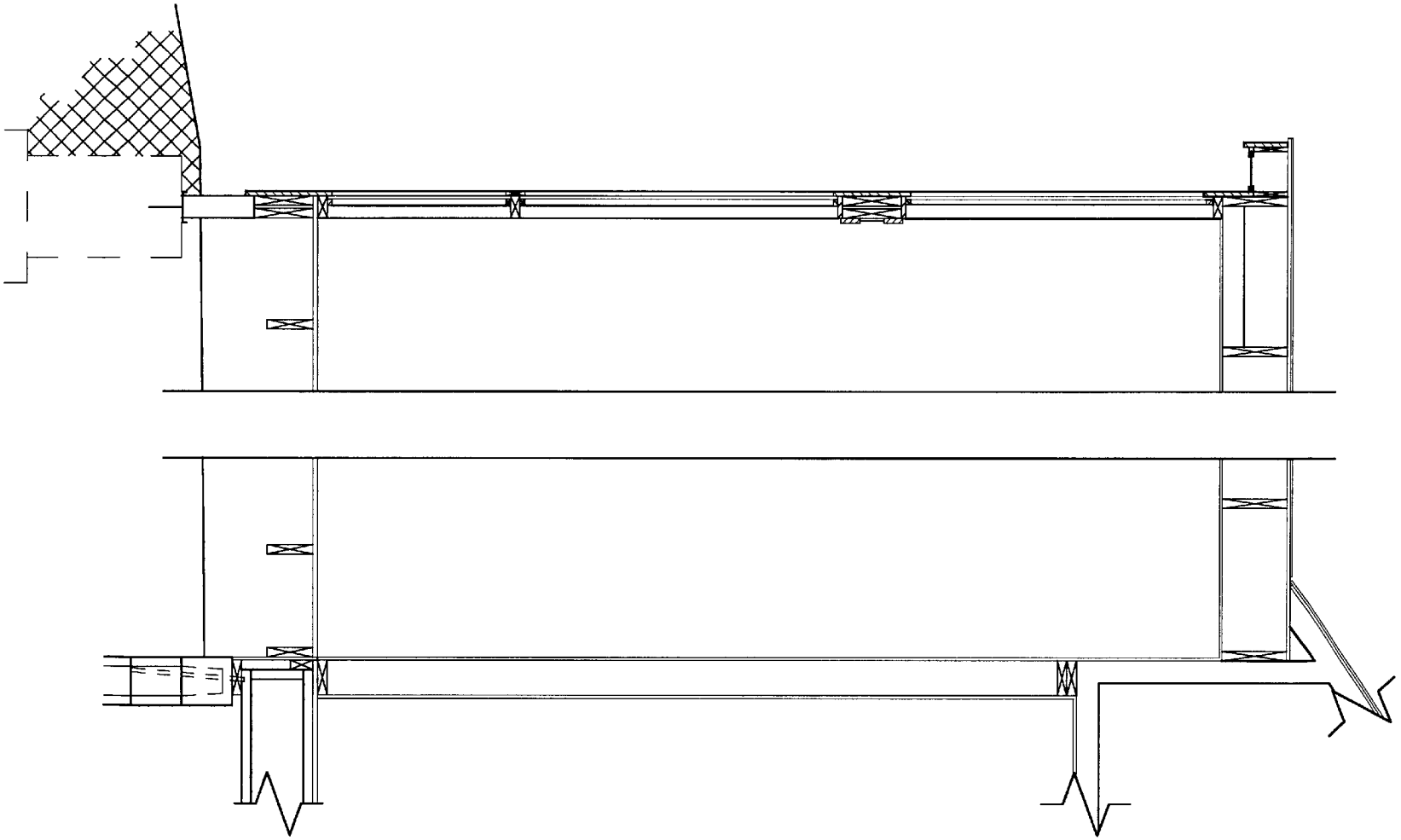
FIG. 12 is a fifth cross section view of the structure of FIG. 1.

Referring to the figures, a home is shown that has multiple floors and multiple rooms. FIG. 1 shows a perspective view of the home. FIGS. 2A and 8 show examples of the floor plans of the ground and mid-level floors. The ground level floor includes the den, the porch, the foyer, the great room, the optional fireplace, the lavatory (i.e., lav), the dining area, the kitchen, the laundry, the 2-car garage, and the optional sideload garage. A flight of stairs leads from the foyer up to the mid-level floor. The mid-level floor is comprised of the master bedroom and the master bath. FIG. 2B shows an example of the first lower level floor. In this example, the first lower level floor includes the family room, bedroom #5, and bath #3. A flight of stairs leads down from the family room to a second lower level floor, e.g., the basement if left unfinished. Another flight of stairs leads from the family room up to the foyer on the ground level floor. In addition, yet another flight of stairs connects the mid-level floor with an upper level floor. The upper level floor is shown in FIG. 2C, and it is comprised of the optional railing and spindles, bedroom #2, bath #2, bedroom #3, and bedroom #4. The front facade of the home is shown in FIG. 3. FIG. 4 is a cross section view in which the first lower level floor is left unfinished as a basement, instead of being finished as a family room and bedroom #5. On the other hand, FIG. 6 is a cross section view in which the first lower level floor is finished as the family room and bedroom #5. FIG. 5 is another cross section view which shows the garage, the kitchen, and the dining area. The foundation is shown in FIG. 7. As can be seen in FIG. 7, a flight of stairs leads up from the second lower level floor, i.e., the basement area, to the first lower level floor, i.e., the lower level slab area, and another flight of stairs goes from the lower level slab area to the ground level floor. FIG. 9 shows the position of the first lower level floor relative to the foundation, and FIG. 10 shows the position of the upper level floor relative to the foundation. FIG. 11 is a cross section view which illustrates the relative positions of the second lower level floor, the first lower level floor, the ground level floor, the mid-level floor, and the upper level floor. FIG. 12 is a cross section view of an optional screened porch. Finally, FIGS. 13, 14, 15A, and 15B provide various details regarding the construction of the home. The master bedroom is on the mid-level floor between the ground level floor and the upper floor. The mid-level floor is preferably midway between a standard room height of eight or nine feet and is accessible via a stairway connecting the upper floor and the ground level floor. The upper floor is preferably no higher than a standard second story construction but it may be somewhat higher or even somewhat lower. The stairway preferably has a landing at the level of the mid-level floor e.g., the first lower level floor then preferably changes direction and continues on up to the upper floor.

Directly below the mid-level floor may be a below ground level floor. This below ground level floor may include a family room or den, a bathroom, bedroom or other usable living space. Alternatively, the below ground level floor may be unfinished or may be a constructed foundation to the necessary height.

The advantages of the present invention will be apparent from the description contained herein. It will be appreciated that after reading this specification those of skill in the art will arrive at various modifications to the invention described herein and these modifications are anticipated to fall within the scope of the present invention and the claims contained herein.

What is claimed is:

1. A building structure, comprising:

at least one room on a first below ground level floor;

at least one room on a second below around level floor said second below ground level floor above said first below ground level floor;

a first stairway connecting said first below ground level floor to said second below ground level floor;

at least one room on a generally ground level floor above said second below ground level floor;

a second stairway connecting said second below ground level floor to said ground level floor;

at least one room on an upper level floor above said ground level floor;

a third stairway connecting said ground level floor with said upper level floor, said third stairway having a first landing at a location between said ground level floor and said upper level floor; and at least one room on a mid-level floor, said at least one room on said mid-level floor accessible from said first landing.

2. The structure of claim 1, wherein:

said at least one room on said second below ground level floor is directly below said at least one room on said mid-level floor.

3. The structure of claim 1, wherein said structure is a residential home.

4. The structure of claim 3, wherein said at least one room on said mid-level floor is a bedroom.

5. The structure of claim 3, wherein said at least one room on said below ground level floor is a family room or den.

6. The structure of claim 1, wherein said structure is comprised of brick exterior walls.

7. The structure of claim 1, wherein said structure is comprised of wood exterior walls.

8. The structure of claim 1, wherein said structure is comprised of stucco exterior walls.

9. The structure of claim 1, wherein said first stairway is connected to said second stairway by a second landing.

10. The structure of claim 1, wherein said second stairway is connected to said third stairway by a third landing.

11. The structure of claim 1, wherein said first below ground level floor is about 6 feet below ground level.

12. The structure of claim 1, wherein said second below ground level floor is about 3 feet below ground level.

13. The structure of claim 1, wherein said ground level floor is about 1 foot above ground level.

14. The structure of claim 1, wherein said mid-level floor is about 6 feet above ground level.

15. The structure of claim 1, wherein said upper level floor is about 12 feet above ground level.

16. The structure of claim 1, wherein a lower section of said third stairway is at an angle relative to an upper section of said third stairway.

17. The structure of claim 16, wherein said angle is about 45 degrees.

* * * * *

UNITED STATES PATENT AND TRADEMARK OFFICE

CERTIFICATE OF CORRECTION

PATENT NO. : 6,244,003 B1
DATED : June 12, 2001
INVENTOR(S) : Eric S. Allison

It is certified that error appears in the above-identified patent and that said Letters Patent is hereby corrected as shown below:

Column 1,
Line 35, please delete the phrase "is a schematic representation of a floor plan"

Signed and Sealed this

Twenty-fifth Day of December, 2001

*Attest:*

*Attesting Officer*

JAMES E. ROGAN
*Director of the United States Patent and Trademark Office*